US008186533B1

(12) United States Patent
Tseng

(10) Patent No.: US 8,186,533 B1
(45) Date of Patent: May 29, 2012

(54) FOOD STORAGE DEVICE

(76) Inventor: Michael Tseng, Palo Alto, CA (US)

( * ) Notice: Subject to any disclaimer, the term of this patent is extended or adjusted under 35 U.S.C. 154(b) by 694 days.

(21) Appl. No.: 11/537,234

(22) Filed: Sep. 29, 2006

(51) Int. Cl.
*B65D 51/00* (2006.01)
*B65D 51/16* (2006.01)

(52) U.S. Cl. ..... 220/287; 220/231; 220/203.04

(58) Field of Classification Search ..... 220/212, 220/213, 231, 240, 287, 305, 309.1, 366.1, 220/780, 791, 793, 794, 795, 913, 203.04, 220/203.07, 203.11, 203.29; 99/340, 346, 99/359, 369, 449; 141/65; 206/524.8
See application file for complete search history.

(56) References Cited

U.S. PATENT DOCUMENTS

| | | | | | |
|---|---|---|---|---|---|
| 2,772,018 | A * | 11/1956 | Weiss | 220/231 |
| 3,055,536 | A * | 9/1962 | Dieny | 220/203.11 |
| 3,815,736 | A * | 6/1974 | Sedlak | 206/501 |
| 3,901,405 | A * | 8/1975 | Norberg | 220/287 |
| 3,943,987 | A * | 3/1976 | Rossi | 206/524.8 |
| 5,147,059 | A * | 9/1992 | Olsen et al. | 220/281 |
| D416,436 | S | 11/1999 | Miller | |
| 6,194,011 | B1 * | 2/2001 | Glaser | 426/123 |
| 6,260,729 | B1 * | 7/2001 | Mitchell et al. | 220/287 |
| D451,338 | S | 12/2001 | Fradkin | |
| 6,325,234 | B1 | 12/2001 | Legaspi | |
| 7,299,941 | B2 * | 11/2007 | McMahon et al. | 220/780 |
| 8,113,246 | B2 * | 2/2012 | Hsieh | 141/65 |
| 2005/0269328 | A1 * | 12/2005 | Crider et al. | 220/276 |
| 2006/0032852 | A1 * | 2/2006 | Cai | 220/287 |
| 2006/0151511 | A1 * | 7/2006 | Kaposi | 220/805 |
| 2006/0169693 | A1 * | 8/2006 | Yeung | 220/287 |
| 2006/0261065 | A1 * | 11/2006 | Claypool et al. | 220/212 |
| 2007/0007299 | A1 * | 1/2007 | Ohler | 220/806 |
| 2007/0215510 | A1 * | 9/2007 | Sung et al. | 206/524.8 |
| 2009/0101535 | A1 * | 4/2009 | Hsieh | 206/524.8 |

* cited by examiner

*Primary Examiner* — Anthony Stashick
*Assistant Examiner* — Brett Edwards
(74) *Attorney, Agent, or Firm* — Milord A. Keshishian

(57) ABSTRACT

A device for storing food products in combination with a component, such as a plate or a bowl, such that a visual indication of secure engagement is provided and the device does not require a specific corresponding mating structure in order to provide an air-tight seal between said device and the component.

20 Claims, 4 Drawing Sheets

FOOD STORAGE DEVICE

FIELD OF THE INVENTION

The invention relates to food storage container arts in general and, more particularly, to the art of sealing leftover food by the use of a self-sealing food storage device that is adapted to function with a variety of enclosing bases and functions without the need for a specifically configured mating base.

BACKGROUND OF THE INVENTION

In the food storage arts, plastic bags were previously used to store food products enclosed therein. Plastic bags evolved into resealable bags, such as the well known ZIP-LOC® bag, that provides a reusable storage bag. In addition, cellophane or saran wrap have been used to cover bowls or dishes enclosing food products therein; however, the thin film does not lend itself to stacking other items thereon.

Various types of food storage devices are also known having the common feature of employing a cover which is removably affixed to a mating base, whereby the cover is adapted to solely engage the specifically designed corresponding base to enclose food products therein. For example, U.S. Pat. No. 6,364,152 to Poslinski et al. discloses a food storage container having a base with a sealing flange and a lid with a sealing lip which are arranged such that the sealing flange and sealing lip engage one another in a mating manner.

The prior art does not address the need for a self-sealing lid that is capable of functioning with a variety of containers. In addition, the prior art fails to provide a self-sealing lid that is rigid in nature and capable of being stacked during refrigeration. Also, the prior art fails to provide a self-sealing food storage container that provides a visual indication that the lid is in an engaged state. Therefore, there remains a long standing and continuing need for an advance in the art of food storage containers, which shortcomings are addressed by the instant invention.

SUMMARY OF THE INVENTION

Accordingly, it is a general object of the present invention to overcome the disadvantages of the prior art.

Another object of the present invention is to provide an improved food storage device.

A further object of the present invention is to provide a food storage device that is readily adapted to function with plates, bowls, dishes or trays of varying sizes or shapes.

Yet a further object of the present invention is to provide a reusable food storage device that is capable of repeated use.

It is another objective of the invention to provide a cost-efficient food storage device both in manufacture and use.

It is another objective of the invention to provide a food storage device that is durable and capable of stacking.

It is a further objective of the invention to provide a food storage device that does not require a specifically configured mating portion for enclosing the food.

It is a further objective of the invention to provide a food storage device that can be used in a microwave oven.

It is still a further object of the invention to provide a food storage device with an engaging mechanism that can provide a visual indication of proper engagement.

In keeping with the principles of the present invention, a unique food storage device is disclosed wherein the device is capable of engaging a variety of components, such as plates, bowls, trays, dishes and the like. In addition, by providing a substantially rigid body, the device lends itself to being stacked. One aspect of the preferred embodiment, has a substantially planar surface to allow stacking of multiple devices upon one another.

In another aspect of the preferred embodiment, a structure is provided that encloses an opening defined by the surface, whereby the structure functions to expel air from within the food storage cavity defined by said outer surface. A suction seal is thereby formed between a peripherally extending member that is attached to the surface, or a wall extending from the surface, and a gas impermeable suction seal is thereby formed within the cavity. The structure allows a visual indication of a secure suction seal because it may be held below the plane of the surface when the device is engaged. In addition, the lateral expansion of the first member upon engagement allows a further visual indication of the gas impermeable seal.

Another aspect of the invention is to provide at least one protrusion that is grasped by the fingers of a user and allows the suction seal to be disengaged by the application of a force in a direction distal to the component.

Such stated objects and advantages of preferred embodiments of the invention are only examples and should not be construed as limiting the present invention. These and other objects, features, aspects, and advantages of the invention herein will become more apparent from the following detailed description of the preferred embodiments of the invention when taken in conjunction with the accompanying drawings and the claims that follow.

BRIEF DESCRIPTION OF THE DRAWINGS

It is to be understood that the drawings are to be used for the purposes of setting forth a preferred embodiment of the invention via illustration only and not as a definition of the limits of the invention. In the drawings, wherein similar reference characters denote similar elements throughout the several views.

DETAILED DESCRIPTION OF THE INVENTION

Figure 1:
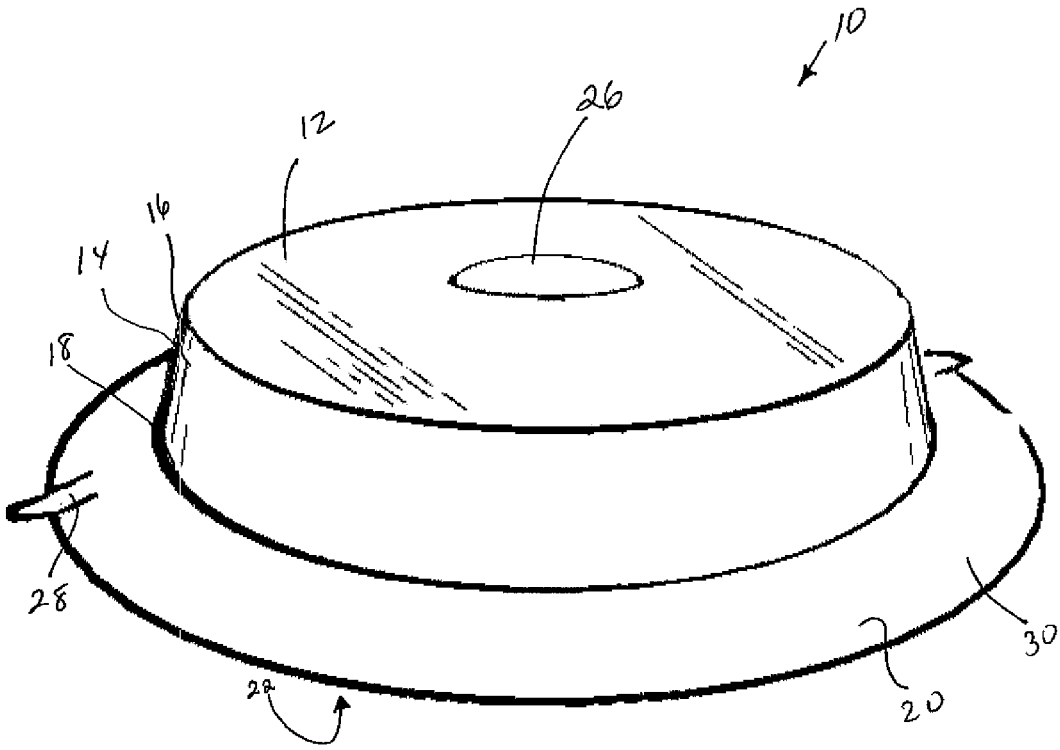
FIG. 1 is a perspective view of a preferred embodiment of a food storage device of the instant invention in an unengaged state.

Referring now to the FIG. 1, a preferred embodiment of a food storage device generally designated by reference numeral 10 is illustrated. It is to be understood that although the invention is illustrated as having a preferred substantially cylindrical shape with a generally flat top, that other shapes may also be utilized without departing from the essence of the invention. For purposes of illustration, but not limitation, device 10 may be dome shaped or rectangular and designed to enclose food therein.

Device 10 has a surface 12 with a substantially peripheral wall 14 extending therefrom. Wall 14 has an upper end 16 and a lower end 18, whereby upper end 16 is in communication with surface 12 and lower end 18 is distal to the surface 12. In a preferred embodiment, surface 12 and wall 14 are substantially rigid and constructed of clear hard plastic or any other substantially rigid material that may be used in conjunction with a microwave oven. However, it is to be understood that surface 12 and wall 14 may also be opaque and constructed of any other substantially rigid material such as, glass, ceramics or the like.

Figure 2:
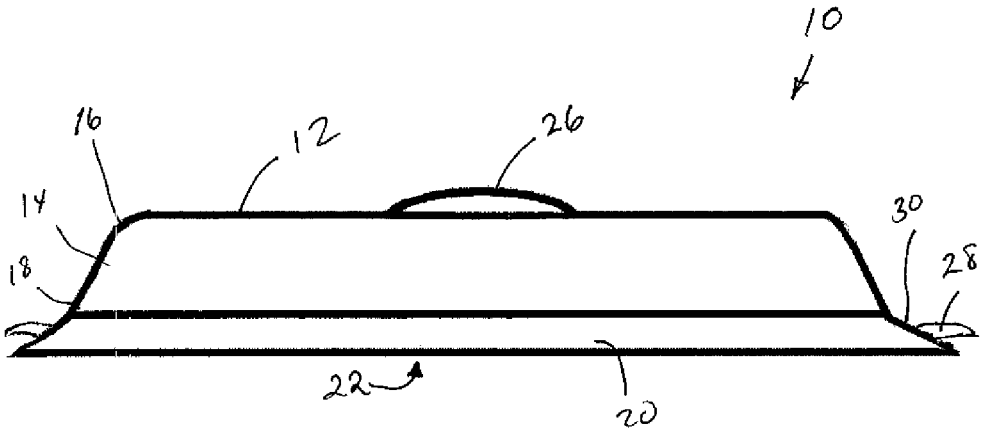
FIG. 2 is a side elevational view of the food storage device in an unengaged state.
Figure 3:
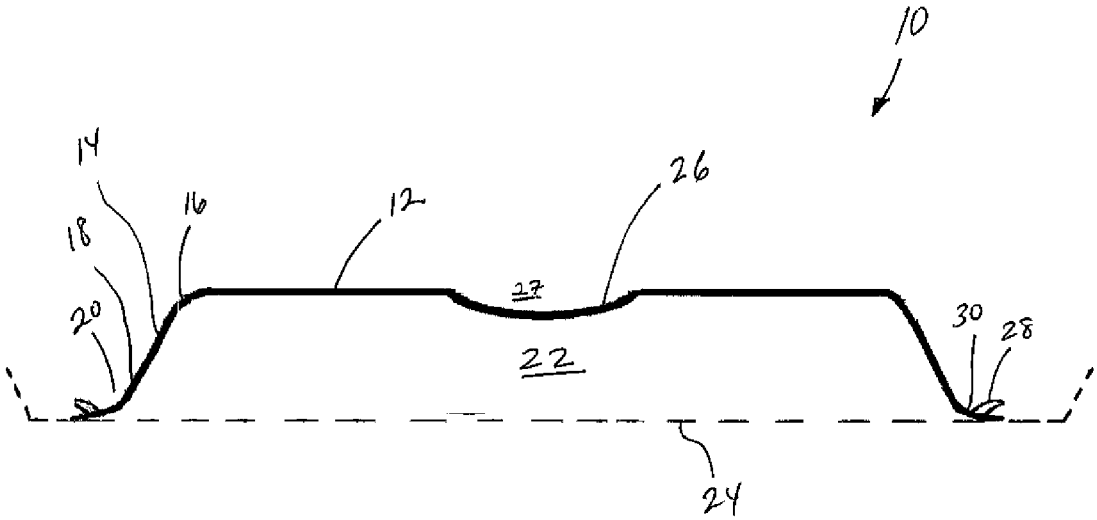
FIG. 3 is a cross-sectional view of the food storage device in an engaged state with a plate taken along line 3-3 of FIG. 1.
Figure 4:
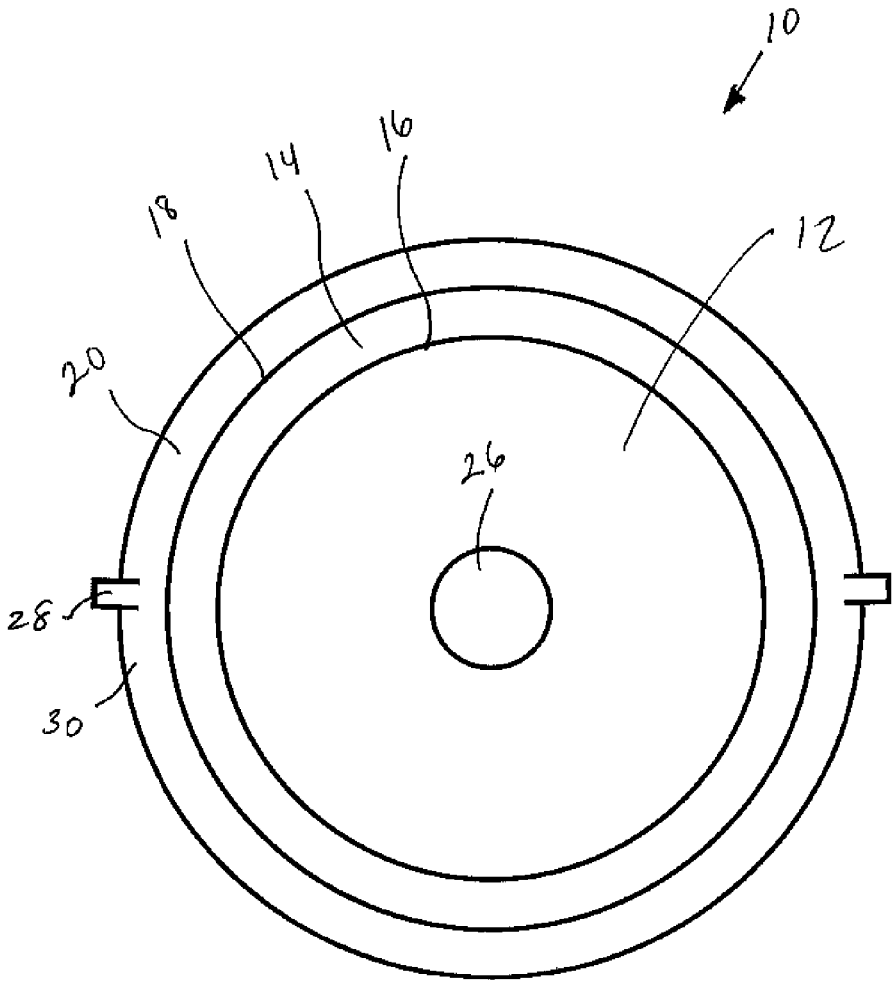
FIG. 4 is a top plan view of the food storage device in an unengaged state.

Now also referring to FIGS. 2 through 4, a first member 20 extends from lower end 18 and is substantially flexible. In a preferred embodiment, first member 20 is constructed of synthetic rubber and is attached to lower end 18 via an extrusion of liquid plastic or adhesive. In the preferred embodiment described herein, first member 20 is substantially annular and extends circumferentially from lower end 18, but may be of any shape which corresponds with the shape of lower end 18. As such, the interior of device 10 defines a cavity 22 within which food may be stored.

Now referring specifically to FIG. 3, a component 24 acts as an engaging surface upon which first member 20 rests. Component 24 may be a dish, bowl, plate or tray or the like to which first member 20 can engage such that any food to be stored is maintained within cavity 22. However, component 24 does not have to be specifically designed to mate with first member 20. It is merely sufficient that component 24 have a substantially even region such that first member 20 may rest upon the even region.

A structure 26 is located on device 10 and is adapted to reduce pressure within cavity 22 by displacing air therefrom. In a preferred embodiment, an opening 27 is defined through surface 12 and structure 26 attaches to surface 12 and encloses opening 27. Structure 26 is attached to surface 12 via the application an extrusion of liquid plastic or adhesive at an outer periphery of structure 26 and the opening 27 defined by surface 12; however, it is to be understood that structure 26 may also be located on wall 14 or take the form of a removable pump (not shown) as is known in the art that displaces air by the use of a one-way valve located on first member 20. In the instant preferred embodiment, structure 26 is formed of flexible synthetic rubber, is substantially dome shaped and is resilient in nature.

In order to enclose food within cavity 22, device 10 is placed over the food such that first member 20 rests upon component 24. Pressure is applied to surface 12 by a user's hand (not shown) such that first member 20 extends outwardly from a central axis. Structure 26 is then pressed inwardly toward cavity 22, thereby expelling air outwardly from in between the engagement of first member 20 and component 24. As such, the pressure within cavity 22 is reduced in relation to the atmospheric pressure and a suction seal is formed between first member 20 and component 24. In addition, as a result of the decreased pressure within cavity 22, structure 26 is maintained in an inwardly shaped position, as illustrated in FIG. 3, and provides a visual indication to the user that the seal between first member 20 and component 24 is secure. Furthermore, a visual indication of a secure engagement is provided by the flattened nature of first member 20 as a result of the suction pressure applied during engagement. Such secure engagement between first member 20 and component 24 prevents air flow between cavity 22, wherein food is maintained, and the outside environment thereby delaying decomposition and prevents odor seepage or exchange during refrigeration.

In order to release the suction seal between first member 20 and component 24, at least one protrusion 28 is provided on an outer surface 30 such that protrusion 28 may be gripped by a user's fingers and an opposing force applied to disengage the seal between first member 20 and component 24. Upon disengagement of the seal between first member 20 and component 24, air is reintroduced into cavity 22 and structure 26 extends outwardly and to its pre-engaged position illustrated in FIGS. 1 and 2.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. A device for use in storing a product on a component, comprising:

a substantially rigid surface having a substantially rigid wall extending peripherally in a substantially vertical manner from said surface and a substantially flexible first member extending peripherally and attaching to a lower end of said wall at an angle, forming a flexible member;

a cavity defined beneath said surface and surrounded by said peripherally extending wall wherein the product is maintained; and a structure for displacing a volume of air such that a secure suction seal is formed between a suction surface of said first member and a component surface of said component without requiring corresponding mating structures on said component and said first member;

wherein said component is substantially planar.

2. The device of claim 1, wherein said product is selected from a group consisting of an organic compound, food, biological specimens, or chemicals.

3. The device for use in storing a product on a component as set forth in claim 1, wherein:

the outer flexible surface includes a flexible protrusion that that extends beyond the free outer periphery and is used to disengage the seal between the flexible first member and the component when the flexible protrusion is maneuvered away from the component, which returns the lower end of the wall above the plane of the inner edge of the flexible surface.

4. The device of claim 1, wherein said wall is attached to said surface and first member by use of adhesive.

5. The device of claim 1, wherein said wall is attached to said surface and first member by extrusion of liquid plastic.

6. The device of claim 1, wherein said structure is a flexible dome shaped object is attached to and covers an opening defined by said surface and communicates with the cavity.

7. The device of claim 6, wherein said structure is made of rubber.

8. The device of claim 6, wherein said first member is made of rubber.

9. The device of claim 6, wherein upon sealing engagement of said first member to said component, said structure extends below a plane of said surface and resides within said cavity.

10. The device of claim 9, wherein upon disengagement of the seal between said first member and said component, said structure returns to its domed shape above the plane of said surface.

11. The device of claim 1, wherein at least a protrusion is provided on said first member to accommodate a user's grip and releases the suction seal.

12. A device for use in storing food products in combination with a component, comprising:

a first piece comprised of:

a substantially rigid surface;

a substantially rigid wall oriented substantially vertical to the substantially rigid surface and having an upper end and a lower end, whereby said upper end attaches to the substantially rigid surface in a substantially peripheral manner at a first angle;

a second piece comprised of:

a substantially flexible first member extending from said lower end in a substantially peripheral manner at a second angle, forming a flexible perimeter;

a cavity defined by said first and second piece, including the substantially rigid surface, said substantially rigid wall, and said substantially flexible first member wherein the food product is maintained; and a structure for displacing a volume of air such that a secure suction seal is formed between a suction surface of said substantially flexible first member and a component surface without requiring corresponding mating structures on said component and said substantially flexible first member;

wherein said component is planar.

13. The device of claim 12, wherein said substantially rigid surface is substantially planar such that an item may be stacked thereon.

14. The device of claim 12, further comprising:

an opening is defined through said substantially rigid surface;

said structure is constructed of a resilient material and is substantially domed shape and said structure is attached to said substantially rigid surface to cover said opening; and said substantially flexible first member is constructed of a resilient material.

15. The device of claim 14, wherein upon sealing engagement of said substantially flexible first member to said component, said structure extends below a plane of said substantially rigid surface and resides within said cavity.

16. The device of claim 15, at least a protrusion is provided on said substantially flexible first member to accommodate a user's grip to release the suction seal between said substantially flexible first member and said component, whereby said structure returns to its domed shape above the plane of said substantially rigid surface.

17. The device of claim 14, wherein the resilient material is rubber.

18. The device of claim 17, wherein a visual indication of engagement between said substantially flexible first member and said component is provided by the structure's maintenance within said cavity.

19. A device for use in storing food products in combination with a component, comprising:

a first piece that includes:

a generally planar and substantially rigid surface that is transparent;

a substantially rigid and substantially vertical wall having an upper end and a lower end, whereby said upper end attaches to the surface in a substantially peripheral manner at a first angle;

a second piece that includes:

a substantially flexible first member extending from said lower end in a substantially peripheral manner at a second angle, forming a flexible member;

a cavity defined by said first and second piece, including the surface, said wall, and said first member wherein the food product is maintained;

an opening is defined through said surface;

a flexible and substantially dome shaped structure positioned over said opening and attached to said surface; whereby the structure is manipulated into said cavity and displaces a volume of air such that a secure suction seal is formed between a suction surface of said first member and a component surface of said component without requiring corresponding mating structures on said component and said first member and said structure is maintained within said cavity during engagement and provides a visual indication of the engagement;

wherein said component is relatively flat.

20. A device for use in storing a product on a component, comprising:

a first substantially rigid piece and a second substantially flexible piece;

the first substantially rigid piece includes:

a substantially rigid surface having a substantially rigid wall oriented at a first angle in relation to the substantially rigid surface, extending peripherally in a substantially vertical manner from said substantially rigid surface, with a cavity defined beneath said substantially rigid surface and surrounded by said peripherally extending substantially rigid wall, within which cavity the product is maintained; and the second substantially flexible piece that includes:

a flexible first member that is oriented at a second angle in relation to the wall;

the flexible first member having a width and an axial length defining a flexible strip with a flexible surface that includes a suction surface and an outer flexible surfaces;

the flexible surface includes lateral edges that are comprise of:

an inner edge and a free outer periphery that substantially extend longitudinally parallel along the axial length of the flexible first member;

the inner edge of the lateral edges is configured commensurate a lower end of the wall, is attached to and extending peripherally from the lower end to orient the flexible first member at the second angle in relation to the wall;

whereby when the first substantially rigid piece is pressed towards the component, the lower end of the wall extends below the flexible surface, which lowers the substantially rigid surface, displacing a volume of air within the cavity from suction surface of the flexible surface to provide a secure suction seal between the suction surface of the flexible first member and a component surface of the component without requiring corresponding mating structures on said component and said flexible first member to seal the product within the cavity;

wherein said component is substantially planar.

* * * * *